United States Patent [19]

Anderson

[11] 3,977,572

[45] Aug. 31, 1976

[54] AEROSOL SAFETY CAP SECURED BY A GROOVED RING

[75] Inventor: Victor F. Anderson, Wenonah, N.J.

[73] Assignee: Shell Oil Company, Houston, Tex.

[22] Filed: Sept. 23, 1974

[21] Appl. No.: 508,377

[52] U.S. Cl. ..... 222/182; 222/402.13; 220/319

[51] Int. Cl.[2] ..... B65D 83/14; B65D 41/18

[58] Field of Search.... 222/153, 182, 402.1–402.13; 220/319, 320, 306, 359; 215/246

[56] References Cited

UNITED STATES PATENTS

| | | | |
|---|---|---|---|
| 3,149,761 | 9/1964 | Harris | 222/402.13 X |
| 3,595,427 | 7/1971 | Markowitz | 222/182 X |
| 3,661,300 | 5/1972 | Nigro | 222/402.13 X |
| 3,690,519 | 9/1972 | Wassilieff | 222/402.13 |

*Primary Examiner*—Robert B. Reeves
*Assistant Examiner*—F. R. Handren

[57] ABSTRACT

A child-proof aerosol package in which the safety cap is permanently fastened to the aerosol container by means of a grooved ring that is attached to the container.

2 Claims, 5 Drawing Figures

AEROSOL SAFETY CAP SECURED BY A GROOVED RING

BACKGROUND OF THE INVENTION

A method of making aerosol containers safe against accidental opening by small children has been to provide a safety cap covering the dispensing valve mechanism, which safety cap permits entry by the finger of an adult person for purpose of actuating the valve mechanism but which cannot successfully be entered by the finger of a very small child. Safety containers of this type are shown, for example, in the Corll U.S. Pat. No. 3,712,515.

It is essential in such a device, however, that either the safety cap be permanently secured to the container, or else the removal of the safety cap will result in removing the actuating valve mechanism as well.

Since products of this type are produced on a large volume basis, and it is inherently desirable to keep the cost of production low, there are severe limitations as to the cost of the materials that may be used and there are also severe limitations with regard to the dimensional tolerance of the various parts of the device that can be successfully achieved in the manufacturing operation. A commercially successful container, therefore, requires structural integrity that can be achieved within the available limitations of cost and dimensional tolerances.

SUMMARY OF THE INVENTION

According to the present invention a plastic ring is secured to the container at the lowermost edge of the bead formed on the upper end of the container. The ring has an outwardly facing groove formed in its external wall somewhat below the location of the container bead. The safety cap is formed witn a generally cylindrical base portion having an interior circumferential flange. The base portion of the safety cap extends around the ring, and the circumferential flange of the safety cap is received within the groove of the ring.

DRAWING SUMMARY

PREFERRED EMBODIMENT

Figure 1:
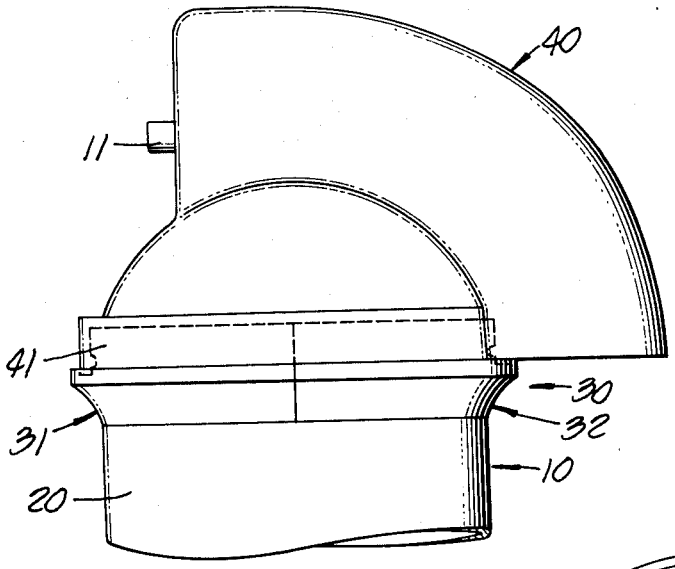
FIG. 1 is an elevation view of the presently preferred form of the invention, with the hidden parts of the structure being partially shown in dotted lines.

Reference is now made to the drawing illustrating the presently preferred form of the invention.

Figure 3:
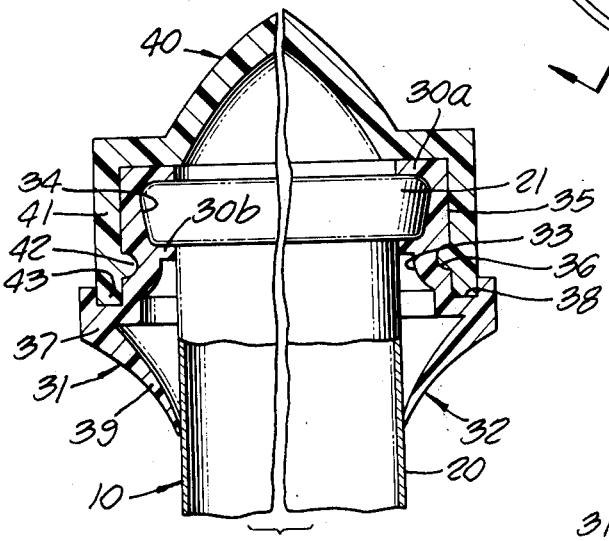
FIG. 3 is a vertical cross-sectional view taken on the lines 3—3 of FIG. 2.

An aerosol package 10 includes a cylindrical metal container 20 above which a plastic safety cap 40 is attached. A conventional dispensing valve mechanism, not shown, is contained within the safety cap 40, and the nozzle 11 protruding from the safety cap is coupled to the dispensing valve mechanism. A ring 30 is used for permanently securing the safety cap 40 to the cylindrical metal container 20 so that it cannot be removed therefrom. Container 20 has a circumferential bead 21 at its upper end, as is conventional, and the bead is shown in FIG. 3 of the drawing. In accordance with the present invention the bead 21 is used as a means for securing the ring 30 in place and the ring 30 in turn is used for holding the safety cap 40 in place.

Figure 5:
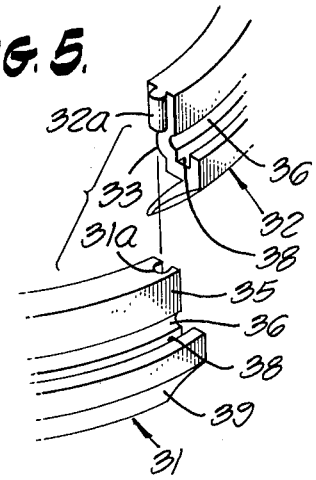
FIG. 5 is a fragmentary perspective view of the plastic ring in its unassembled form.
Figure 2:
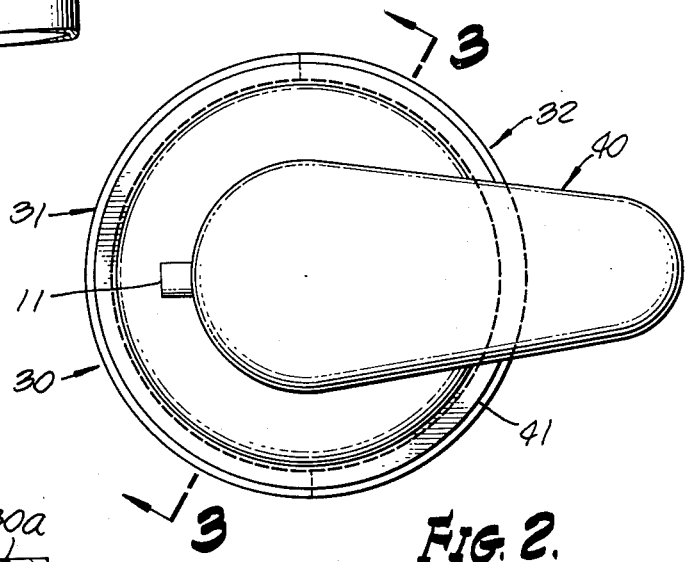
FIG. 2 is a top plan view of the aerosol package of FIG. 1.
Figure 4:
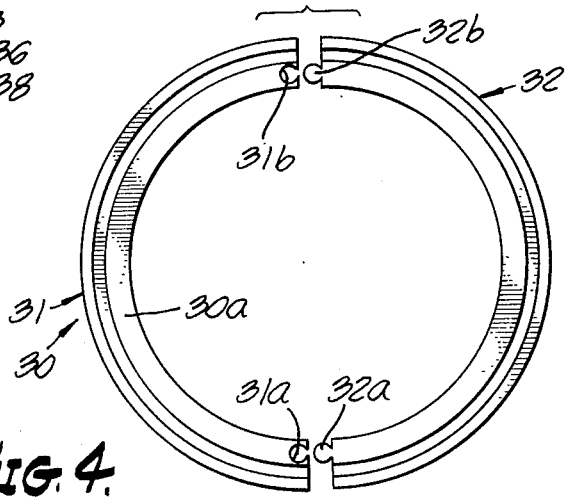
FIG. 4 is a top plan view of the plastic ring in its unassembled form.

Ring 30 is made in at least two circumferential segments, and in accordance with the preferred form of the invention as presently illustrated it includes two segments 31, 32. Each of the segments provides one-half the circumference of the ring. On the ends of segments 31 a pair of vertical recesses **31*a*, and 31*b* are formed. Each of these recesses is of cylindrical configuration except that approximately 90° of its circumference is open at the end of the segment 31. Ring segment 32 on its two ends has protruding bulbs 32*a*, 32*b* which are of cylindrical configuration and adapted to be received within the respective recesses 31*a*, 31*b*. These joining means for connecting the segments 31, 32 together are shown in FIGS. 4 and 5** but not elsewhere in the drawing.

The plastic ring 30 has an internal wall surface generally identified by the numeral 33. In the upper portion of ring 30 the wall surface 33 has an annular recess 34, and this recess is of such a shape or configuration as to fit securely about the bead 21 of container 20. On its external surface 35 the ring 30 has a circumferential groove 36, and this groove is located somewhat below the elevation of the container bead 21.

Ring 30 at its upper extremity has an inwardly directed circumferential flange **30*a* which rests upon the horizontal upper surface of the container bead 21. About midway of its vertical height the ring 30 also has an inwardly directed circumferential flange 30*b* which engages the exterior wall of container 20 immediately beneath the container bead 21, as well as engaging the horizontal undersurface of the bead 21. Beneath the outwardly opening recess 36 the ring 30 has a horizontally outwarding projecting flange portion 37, and the upper surface of flange 37 is recessed at 38 to provide a circumferential annular recess. The lowermost portion of ring 30 is an apron 39 which projects downwardly and inwardly from the outer extremity of flange 37 becoming narrower and thinner as it projects down toward a point which engages the circumferential outer surface of container 20.**

In the safety cap 40 a base portion 41 has a generally cylindrical configuration. Near the lower extremity of base portion 41 there is formed an interior circumferenial flange 42 which projects inwardly from the wall of base portion 41. The downwardly projecting extremity of base portion 41 is designated by numeral 43.

It will therefore be seen that on the lower extremity of the safety cap 40 there are formed both downwardly and radially inwardly extending projections, the downwardly projecting extending projection being designated by numeral 43 while the radially inwardly projection is designated by numeral 42. It will also be seen that the ring 30 has an exterior groove 36 in its vertical wall, while the horizontal flange 37 has an upwardly opening recess or groove 38. The grooves 36, 38 of the ring 30 are adapted to receive the projections 42, 43 respectively, of the safety cap 40.

According to the present invention the novel method of securing the safety cap to the aerosol container is carried out as follows. On the lower extremity of the safety cap both downwardly extending and radially inwardly extending projections are formed. The ring 30 is selected to have exterior grooves adapted to concurrently receive both of the projections of the safety cap. The ring 30 is placed about the container 20 and is secured to the container at the lowermost edge of the container bead 21. The safety cap 40 is then placed above the container with the lower extremity, or base portion, of the safety cap being in engagement with the ring 30, and more specifically with both the horizontal and vertical projections from the safety cap being received by the corresponding grooves of the ring.

Still more specifically, one of the ring segments is first placed about the bead 21 of the container in engagement therewith. Then the other ring segment is placed in its proper position and concurrently joined to the first ring segment. In this connection it will be noted that the bulbs 32*a* and 32*b*, and the recesses 31*a* and 31*b*, are of limited vertical excursion such that they are contained within the inwardly turned horizontal upper flange 30*a* of the ring 30.

It will be understood that the plastic material from which safety cap 40 is made is inherently resilient to some degree. The base portion 41 of the safety cap may therefore be distorted somewhat in the course of securing it to the ring 30. There is also some accompanying distortion of the ring 30, and particularly the apron portion 39, thereof, since the flange 37 must bend downwardly and the apron 39 must fold inwardly upon itself in order to permit the vertically downwardly projecting portion 43 of the safety cap 40 to be fully received within the recess or groove 38. A snap-action fitting is achieved and when the lower portion of base 41 of the safety cap 40 is properly seated the stretching of the base portion that was previously required is then relieved, and at the same time the folding action that was required of the ring apron 39 is relieved. When the safety cap is secured to the ring in its proper position as shown in FIG. 3, neither upward or downward force on the safety cap will be effective in any manner to dislodge it from the aerosol container. It is not possible for a small child to detach the safety cap 40. An adult, however, might be able to detach the safety cap by depressing the flange portion 37 of ring 30 downwardly, then pulling a portion of the circumference of the base portion 41 of the safety cap radially outwardly, and at the same time lifting the safety cap in an upward direction. Even this method of removing the safety cap is, however, extremely difficult.

While in order to comply with the statute the invention has been described in language more or less specific as to structural features, it is to be understood that the invention is not limited to the specific features shown but that the means and construction herein disclosed comprise a preferred form of putting the invention into effect, and the invention is therefore claimed in any of its forms or modifications within the legitimate and valid scope of the appended claims.

The term "plastic" as used in the specification and claims means any resilent material having plastic-like properties.

What is claimed is:

1. An aerosol package comprising:

a cylindrical aerosol container having a circumferential bead on its upper end;

a plastic cap extending above the upper end of said container and having a generally cylindrical base portion, said base portion having on its lower extremity both downwardly extending and radially inwardly extending projections;

and a plastic ring extending around the upper end portion of said container, said ring being formed from at least two circumferential segments having joining means formed thereon, said ring on its internal surface having an annular supporting recess which receives said circumferential bead of said container and is in supporting engagement therewith, said ring also extending below said bead and having a circumferential outwardly extending flange, the external surface of said ring and the upper surface of said flange each having a groove in which said downwardly and inwardly extending projections of said plastic cap are received, said ring also having a circumferential apron which projects downwardly and inwardly from the outer extremity of said circumferential flange, said apron being adapted to flex inwardly upon itself in order to permit receipt of said projections by said grooves, whereby said cap is securely fastened to said container.

2. The method of securing a plastic safety cap to the upper end of a cylindrical aerosol container which has a circumferential bead on its upper end, comprising the steps of:

selecting at least two circumferential ring segments having joining means on their ends and adapted to cooperatively form a ring having an annular recess in its interior wall surface, and also having a circumferential groove in its external wall surface located below said recess;

placing said ring segments about said container bead so as to receive said bead within said recess;

joining said ring segments together;

forming on said safety cap a generally cylindrical base portion having an interior circumferential flange; and resiliently stretching said base portion of said safety cap and concurrently placing same about said ring so that said flange is received within said groove; said base portion being then securely retained when the stretching action is relieved.

* * * * *